United States Patent [19]

Clement et al.

[11] Patent Number: 4,643,153

[45] Date of Patent: Feb. 17, 1987

[54] ELECTRONIC ARRANGEMENT FOR GENERATING A FUEL METERING SIGNAL FOR AN INTERNAL COMBUSTION ENGINE

[75] Inventors: Albrecht Clement, Kornwestheim; Gustav Virgilio, Winnenden; Hugo Weller, Oberriexingen, all of Fed. Rep. of Germany

[73] Assignee: Robert Bosch GmbH, Stuttgart, Fed. Rep. of Germany

[21] Appl. No.: 777,639

[22] Filed: Sep. 19, 1985

[30] Foreign Application Priority Data

Sep. 19, 1984 [DE] Fed. Rep. of Germany ..... 3434339

[51] Int. Cl.[4] ..... F02D 41/04

[52] U.S. Cl. ..... 123/486; 123/478

[58] Field of Search ..... 123/478, 480, 486, 490, 123/491, 488; 364/431.05, 431.12

[56] References Cited

U.S. PATENT DOCUMENTS

| | | | |
|---|---|---|---|
| 3,683,871 | 8/1972 | Barr et al. | 123/491 |
| 4,438,748 | 3/1984 | Ikeura et al. | 123/491 |
| 4,515,130 | 5/1985 | Hasegawa | 123/493 |
| 4,543,937 | 10/1985 | Amano et al. | 123/491 |

FOREIGN PATENT DOCUMENTS

| | | | |
|---|---|---|---|
| 28537 | 2/1983 | Japan | 123/491 |
| 28540 | 2/1983 | Japan | 123/491 |

*Primary Examiner*—Tony M. Argenbright

*Attorney, Agent, or Firm*—Walter Ottesen

[57] ABSTRACT

An electronic arrangement is disclosed for generating a fuel metering signal which is formed by applying the formula $ti = f[x_n, g(U_{Batt}, y)]$. Accordingly, the battery voltage is corrected by means of a characteristic field. In this arrangement, allowance can be made for particularly speed and/or load dependent values in addition to the battery voltage.

7 Claims, 2 Drawing Figures

ELECTRONIC ARRANGEMENT FOR GENERATING A FUEL METERING SIGNAL FOR AN INTERNAL COMBUSTION ENGINE

FIELD OF THE INVENTION

The invention relates to an electronic arrangement for generating a fuel metering signal for an internal combustion engine in dependence upon operating characteristic quantities and a correction of the battery voltage.

BACKGROUND OF THE INVENTION

In known systems, a basic injection signal is formed in dependence on engine speed and load which, among others, is then also corrected in dependence on the battery voltage. The reason for this is that the pick-up time of injection depends to a substantial degree on the battery voltage. If the voltage were not corrected electronically, a delayed response of the injection valves ensuing therefrom would result in an insufficient duration of injection and thus an insufficient quantity of fuel injected. The lower the battery voltage, the less fuel would be supplied to the internal combustion engine. For this reason, a low battery voltage as it occurs, for example, during and after a cold start with the battery greatly discharged, has to be compensated for by a correspondingly selected extension of the base duration of injection in order for the internal combustion engine to receive the proper amount of fuel, the base duration of injection being dependent upon the speed and the load. In this connection, reference may be had to the publication "Bosch, Technische Unterrichtung, L-Jetronic", April 1981, pages 16 and 17.

In known systems, the voltage correction acts additively and is generated by means of a characteristic curve. This voltage correction is taken as a separate correction quantity.

However, in some operating ranges, this voltage correction does not perform optimally because of misadjustments at certain points.

SUMMARY OF THE INVENTION

In view of the above, it is on object of the invention to provide an arrangement for correcting the battery voltage for fuel metering signals which provides optimum values over the entire spectrum of the operating characteristic quantities.

The electronic arrangement of the invention for generating a fuel metering signal makes it possible to correct the battery voltage very accurately and thereby actually deliver the desired amount of fuel to the engine. With a view to low pollutant emissions and optimum operation of the internal combustion engine, the arrangement of the invention has proved to be highly efficient.

BRIEF DESCRIPTION OF THE DRAWING

Embodiments of the invention will now be described in more detail in the following with reference to the drawing wherein.

DESCRIPTION OF THE PREFERRED EMBODIMENTS OF THE INVENTION

The embodiments relate to arrangements of the invention for a spark ignition internal combustion engine having intermittent injection.

Figure 1:
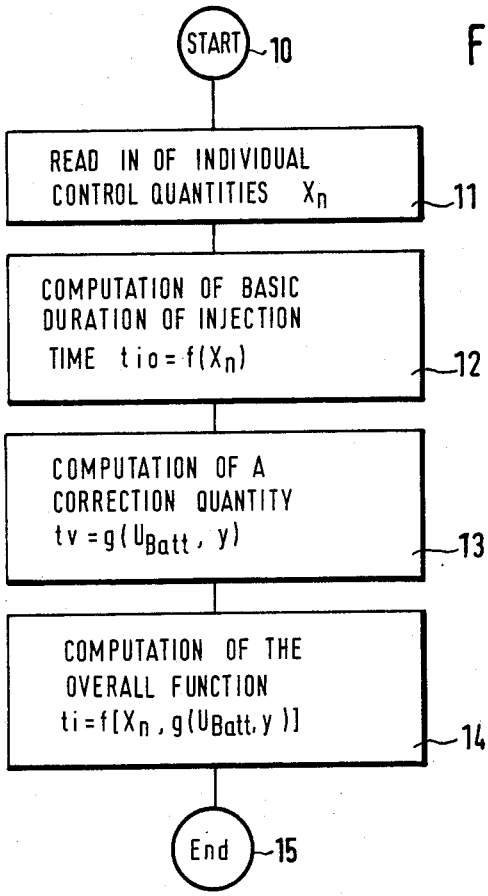
FIG. 1 is a flowchart illustrating the computation sequence of an injection duration signal formed pursuant to the invention; and, FIG. 2 is a block diagram explaining the invention by way of example with reference to a circuit configuration.

The flowchart of FIG. 1 shows in rough outline the computation sequence of a signal indicative of the duration of injection that is formed in accordance with the invention.

The program starts at reference numeral 10. Then follows a block 11 in which the individual control quantities $x_n$ such as engine speed, load and temperature are read in. The next block 12 serves to compute a basic duration of injection tio in dependence on the control quantities $x_n$. It is followed by block 13 in which a correction quantity tv is formed as a function g of the battery voltage and of further quantities. This correction quantity is shown in block 13 of FIG. 1 as $$tv = g\,(U_{Batt}, y)$$

Figure 2:
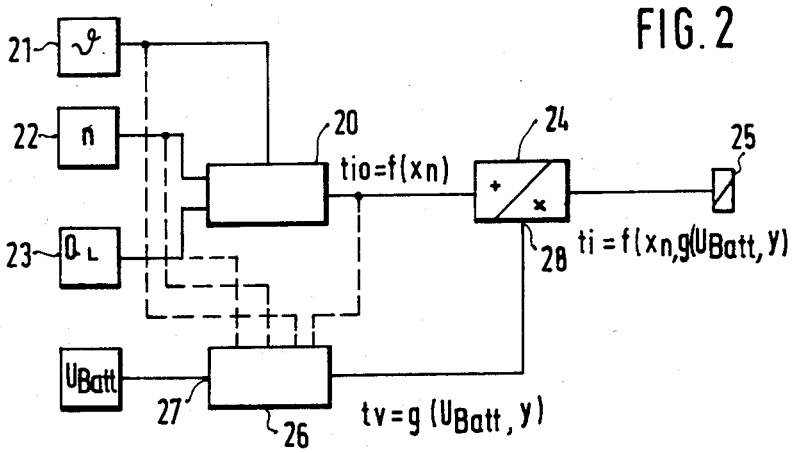

The correction quantity is also shown on FIG. 2. Finally, a block 14 serves to compute the overall function for the duration of injection $$ti = f\,[x_n, g\,(U_{Batt}, y)].$$

The program cycle terminates at 15.

According to the flowchart of FIG. 1 of the invention, the correction quantity is formed in dependence on the battery voltage $U_{Batt}$ with at least one further quantity y being utilized. This is realized, for example, by means of a characteristic field for the correction quantity wherein at least one dimension of the correction quantity is the battery voltage. This arrangement ensures that the correction of the battery voltage does not depend solely on the battery voltage but may be referred to at least one further quantity. In contrast to the pure characteristic control as known in the art, this arrangement permits a substantially finer adjustment.

In a specific type of internal combustion engine, the computation of the correction value tv has yielded the engine speed for the further independent quantity y. Likewise, good results are achievable if the air flow rate or the basic injection signal tio is used as the quantity y which ultimately corresponds to the quotient of load and engine speed (corrected, if necessary, by means of temperature values).

Referring now to FIG. 2, reference numeral 20 identifies a basic injection pulse generator receiving input quantities from a temperature sensor 21, an engine speed sensor 22 and a load sensor 23. The basic injection pulse generator 20 is followed by a correcting stage 24 and finally an injection valve 25. Reference numeral 26 identifies a correction signal generator which receives a battery voltage signal at its control input 27 as well as receiving selectively at least one of the output quantities of sensors 21 to 23 or the output quantities of basic injection pulse generator 20. Correction signal generator 26 issues at its output the correction signal $tv = g\,(U_{Batt}, y)$ which is passed to a control input 28 of correcting element 24. In this arrangement, the correction of the basic injection signal in correcting element 24 may be accomplished additively and/or multiplicatively.

The question as to which quantities other than the battery voltage are referred to for the generation of the correction signal tv is to be answered on a case-by-case basis depending on the type of internal combustion engine involved, these quantities being suitably determined empirically.

In its simplest embodiment, correction signal generator 26 is made up of a three-dimensional characteristic field including the independent variables battery voltage and one of the quantities engine speed, load, basic duration of injection or temperature. It is to be understood that correction signal generator 25 may also include a higher dimensional characteristic field. It is only necessary to ensure that the correction quantity is not only influenced by the battery voltage but also by further operating characteristics.

Finally, the possibility exists to form the overall function as it appears from block 14 of FIG. 1 directly, that is, without performing the preceding computations in blocks 12 and 13. This applies in the event that y is not already a computed quantity itself.

It is understood that the foregoing description is that of the preferred embodiments of the invention and that various changes and modifications may be made thereto without departing from the spirit and scope of the invention as defined in the appended claims.

What is claimed is:

1. An electronic arrangement for generating a fuel metering signal for an internal combustion engine in dependence upon operating characteristic quantities and a battery voltage correction, the arrangement comprising:

circuit means for forming the metering signal in accordance with the equation $$ti = f[x_n, g(U_{Batt}, y)]$$

wherein $x_n$ is at least dependent upon load and rotational speed, $U_{Batt}$ is the battery voltage and y is dependent upon operating characteristic quantities.

2. The electronic arrangement of claim 1, said value y being dependent upon at least one of the quantities of the group consisting of temperature, rotational speed and load.

3. The electronic arrangement of claim 1, said value y being dependent upon the basic injection time tio.

4. The electronic arrangement of claim 1, said function g ($U_{Batt}$, y) being determined by means of a characteristic field.

5. The electronic arrangement of claim 1, comprising means for forming a basic metering signal; and, correction means for additively correcting said basic metering signal by means of the function g($U_{Batt}$, y).

6. The electronic arrangement of claim 1, comprising means for forming a basic metering signal; and, correction means for multiplicatively correcting said basic metering signal by means of the function g($U_{Batt}$, y).

7. The electronic arrangement of claim 1, comprising means for forming a basic metering signal; and, correction means for additively and multiplicatively correcting said basic metering signal by means of the function g($U_{Batt}$, y).

* * * * *